US006708350B2

(12) United States Patent
Devereux

(10) Patent No.: US 6,708,350 B2
(45) Date of Patent: Mar. 23, 2004

(54) DEFLECTOR ARRANGEMENTS

(75) Inventor: Mark Devereux, Nottingham (GB)

(73) Assignee: Gordon Ellis & Co., Derby (GB)

( * ) Notice: Subject to any disclaimer, the term of this patent is extended or adjusted under 35 U.S.C. 154(b) by 0 days.

(21) Appl. No.: 10/171,314

(22) Filed: Jun. 12, 2002

(65) Prior Publication Data

US 2002/0194672 A1 Dec. 26, 2002

(30) Foreign Application Priority Data

Jun. 14, 2001 (GB) ..... 0114467

(51) Int. Cl.[7] ..... A47K 10/18
(52) U.S. Cl. ..... 4/300.3; 4/DIG. 5
(58) Field of Search ..... 4/300.3, DIG. 5, 4/478, 483, 235, 237, 239, 902

(56) References Cited

U.S. PATENT DOCUMENTS 1,251,877 A * 1/1918 Erickson ..... 4/450
2,035,567 A * 3/1936 Piper ..... 4/301
2,133,416 A * 10/1938 Bentz ..... 4/239
2,141,341 A * 12/1938 Bentz ..... 4/237
2,393,050 A * 1/1946 Dobreff ..... 112/470.14
2,545,598 A * 3/1951 Barnes ..... 4/239
2,686,320 A * 8/1954 Feldstein ..... 4/239
2,703,407 A * 3/1955 Henock et al. ..... 434/247
2,850,744 A * 9/1958 Nika et al. ..... 4/239
3,614,790 A * 10/1971 Binllingsly et al. ..... 4/300.3
4,716,602 A 1/1988 Brickhouse
5,465,431 A 11/1995 Wertz
5,625,905 A 5/1997 Woods
5,983,410 A 11/1999 Webster
6,032,302 A 3/2000 Eckert
6,408,447 B1 6/2002 Burbank

* cited by examiner

*Primary Examiner*—Gregory L. Huson
*Assistant Examiner*—Huyen Le
(74) *Attorney, Agent, or Firm*—Smith-Hill and Bedell

(57) ABSTRACT

A deflector arrangement (10) comprising a deflector (12) and means (14) to attach the deflector (12) to a toilet (T) and enable the deflector (12) to be selectively moved to and from an operable position in which the deflector (12) can deflect urine into the toilet (T).

18 Claims, 22 Drawing Sheets

DEFLECTOR ARRANGEMENTS

The present invention relates to deflector arrangements and particularly but not exclusively to deflector arrangements for deflecting a stream of urine in to a toilet.

When males sit on a toilet for use, which is often a necessity for elderly, infirm or disabled males, occasionally urine is accidentally directed over the front of the toilet. This soils the area around the toilet presenting problems of hygiene and moreover a cause for embarrassment to the male concerned.

According to the present invention there is provided a deflector arrangement comprising a deflector and means to attach the deflector to a toilet and enable the deflector to be selectively moved to and from an operable position in which the deflector can deflect urine into the toilet.

Preferably the means enables the deflector to be moved between said operable position and one or more further position(s) in which the deflector presents no or substantially no obstacle to a user of the toilet, particularly when the user is getting on and off the toilet.

Preferably the deflector is located generally at the front of the toilet when in the operable position, and desirably generally centrally whereby to locate between the legs of a person sitting on the toilet.

Preferably the deflector is located generally beneath the seating area of a toilet, and preferably is on the outside of the toilet when in the said further position(s).

The deflector preferably comprises a concave surface which when in the operative position generally faces a person sitting on the toilet, whereby to direct urine impinging thereon into the toilet. The deflector may extend, in part, into the toilet whereby to facilitate direction of urine therein.

Preferably the said means comprises a first part attachable to a toilet and a second part operable to enable movement, desirably pivotal movement, of the deflector on the first part. The second part may be articulated, and preferably comprises a series of pivotal joints along a length connecting the first part to the deflector. Some or all of the joints may be of the form of ball and socket joints or similar to provide multi-axial pivotal movement.

The first part may be removably attachable to a toilet, for example by way of a releasable adhesive and/or fixings such as threaded fixings. Alternatively the first part may be substantially permanently attached to the toilet.

The arrangement may be attachable to the main body or bowl of the toilet, or alternatively to a seat member of a toilet.

Still further according to the present invention there is provided a toilet comprising a deflector arrangement as described in any of the preceding paragraphs.

The invention also provides a toilet seat comprising a deflector arrangement as described in any of the preceding paragraphs.

An embodiment of the present invention will now be described by way of example only, with reference to the accompanying drawings in which.

Figure 1:
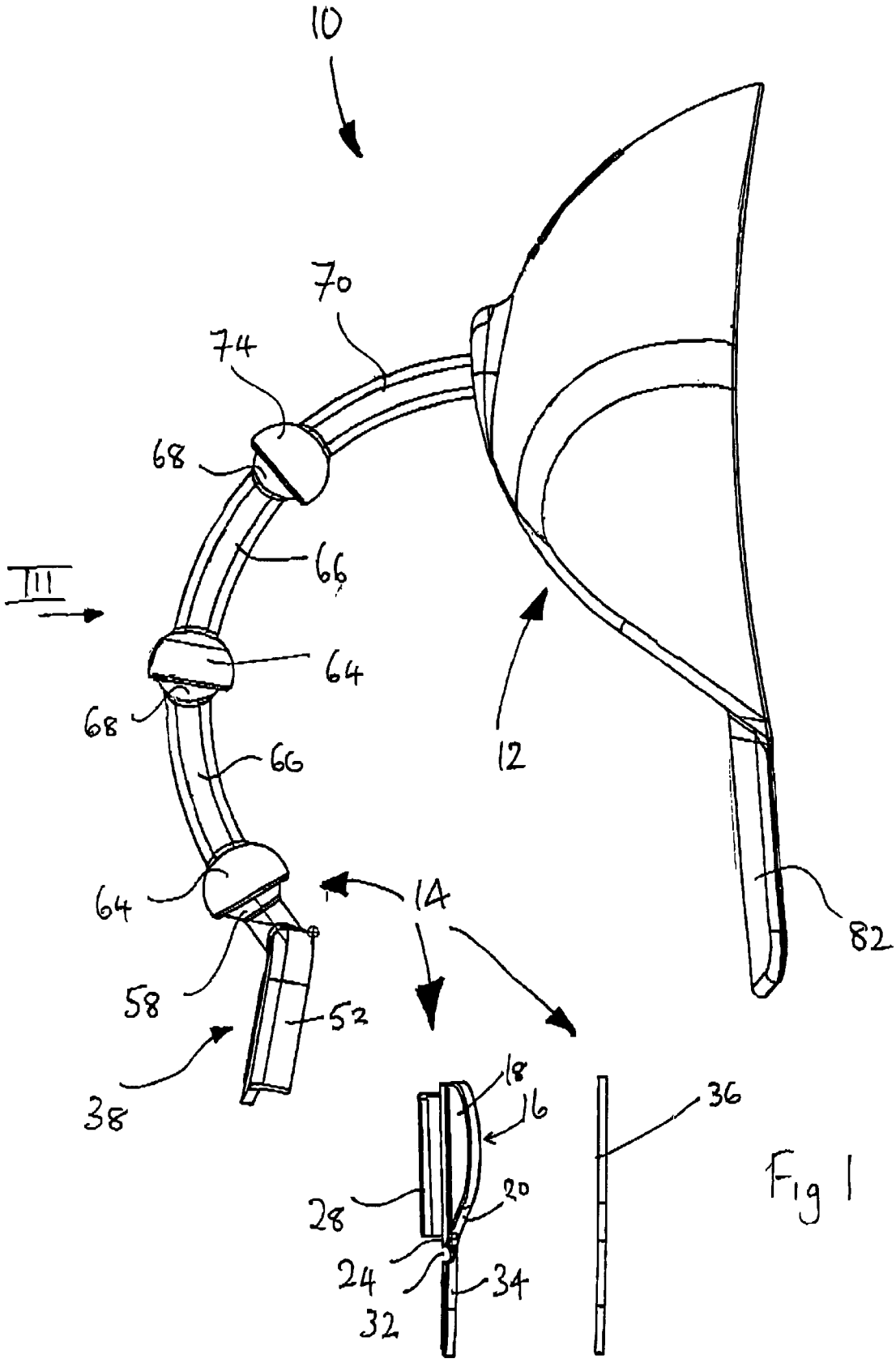
FIG. 1 is a diagrammatic, partially disassembled, side view of a deflector arrangement according to the present invention.

Referring to the drawings there is provided a deflector arrangement 10 comprising a deflector 12 and means 14 to attach the deflector 12 to a toilet T and enable the deflector 12 to be selectively moved to and from an operable position in which the deflector 12 can deflect urine into the toilet T.

Figure 7:
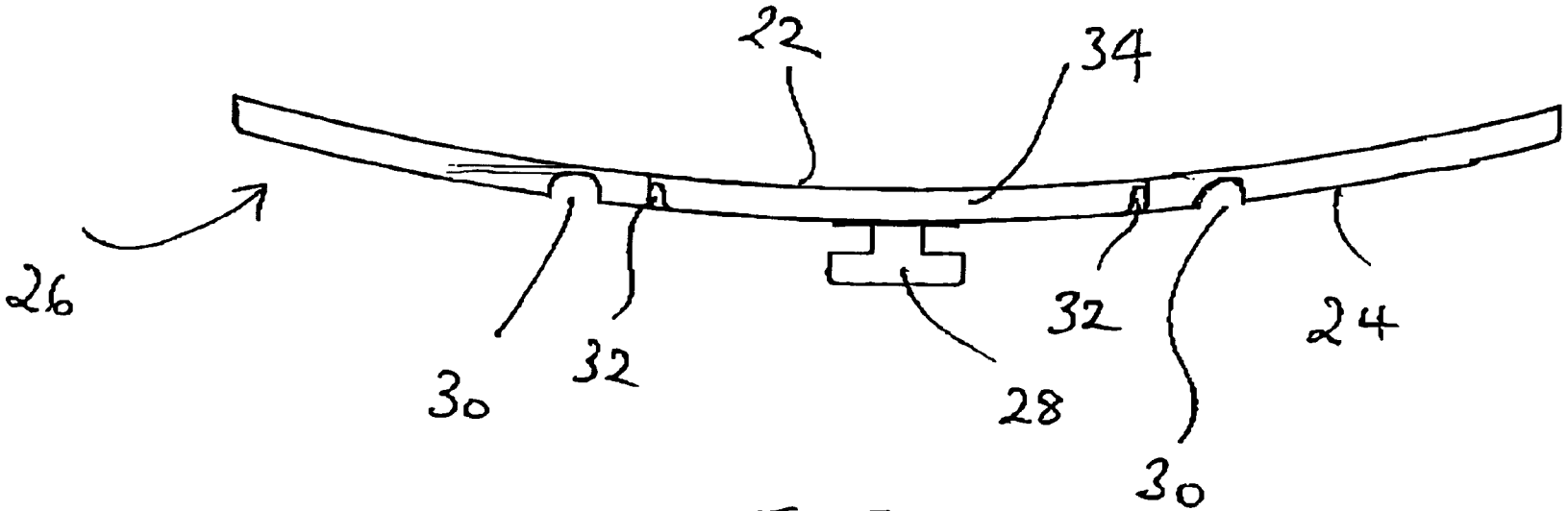
FIG. 7 is a view from above, in the direction of arrow VII of FIG. 4.
Figure 8:
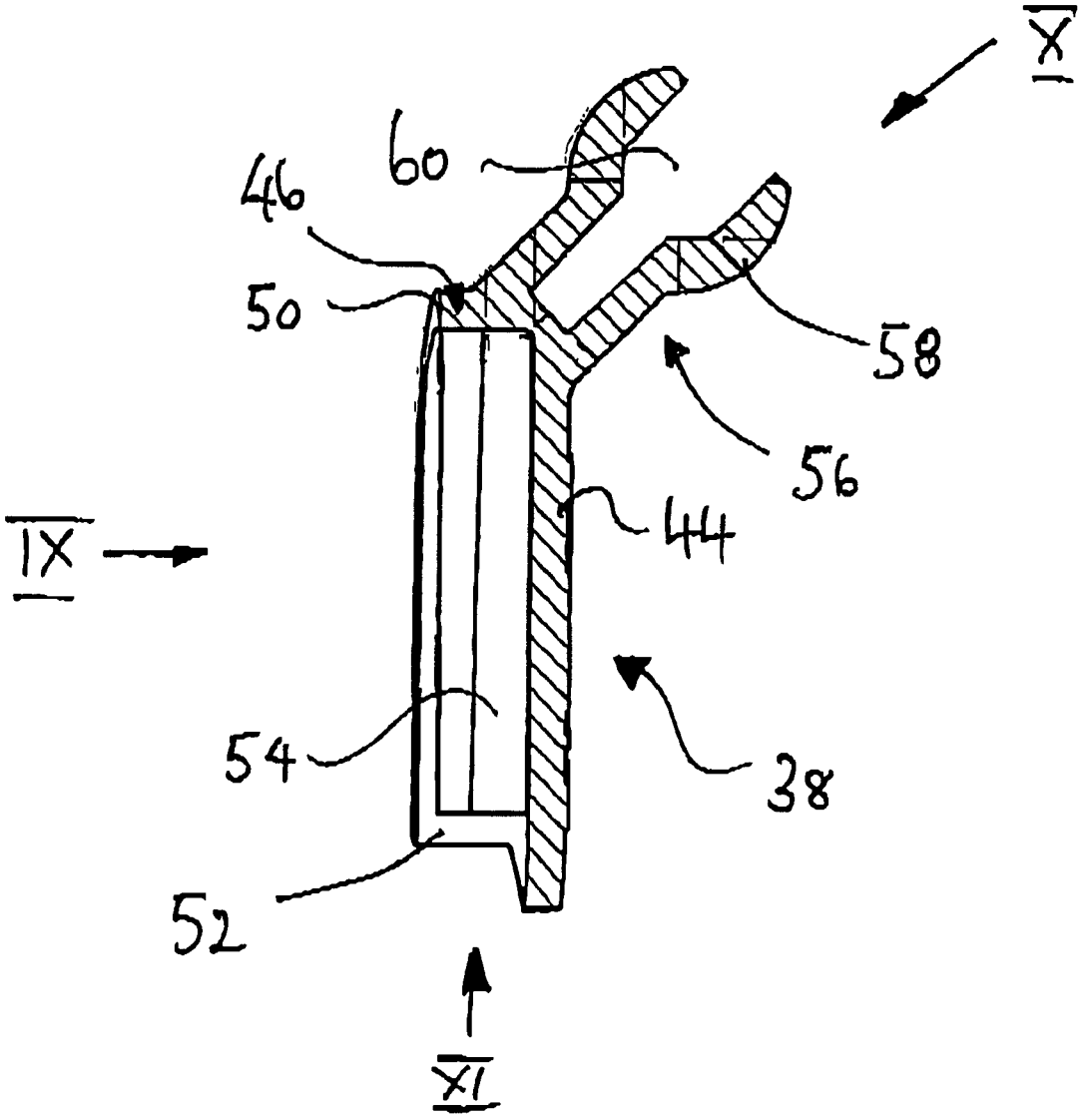
FIG. 8 is a cross-sectional view of a section of a second part of the arrangement of FIG. 1.
Figure 9:
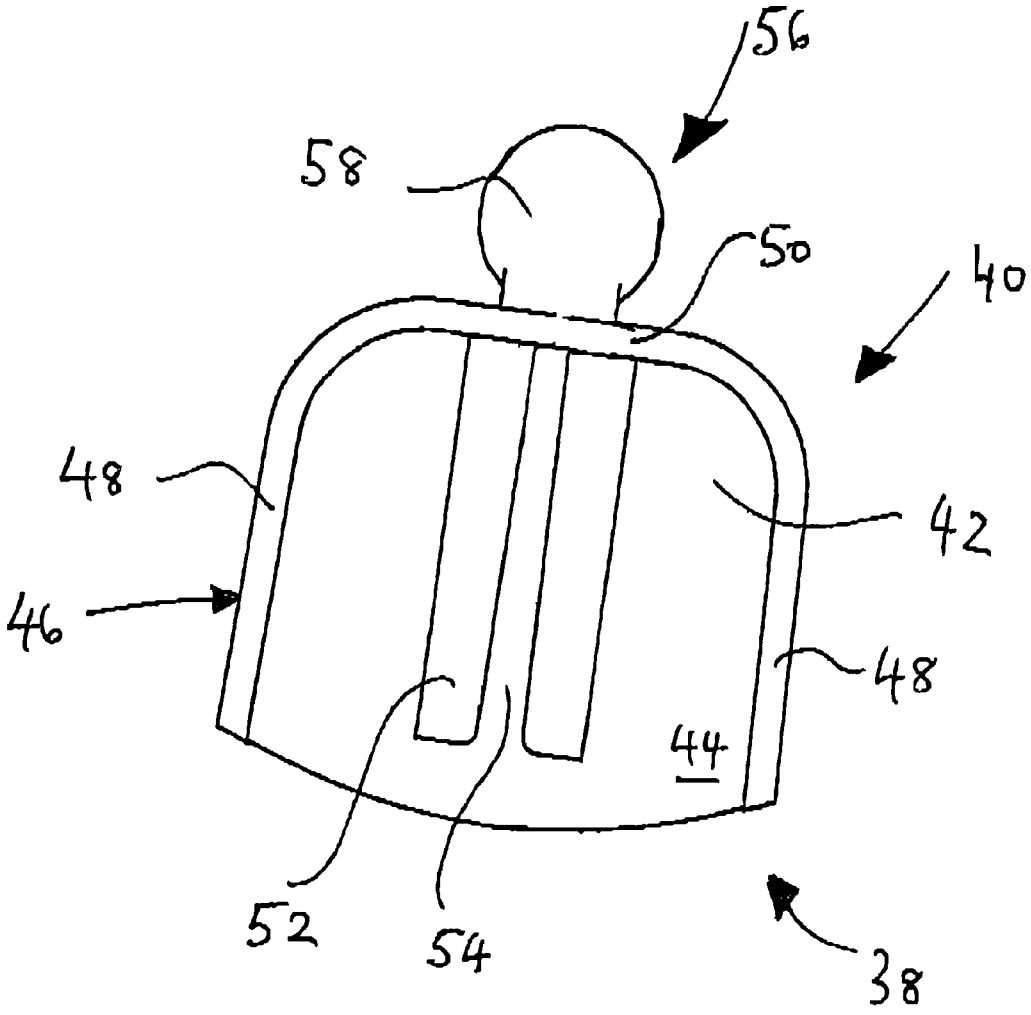
FIG. 9 is a view in the direction IX of FIG. 8.
Figure 10:
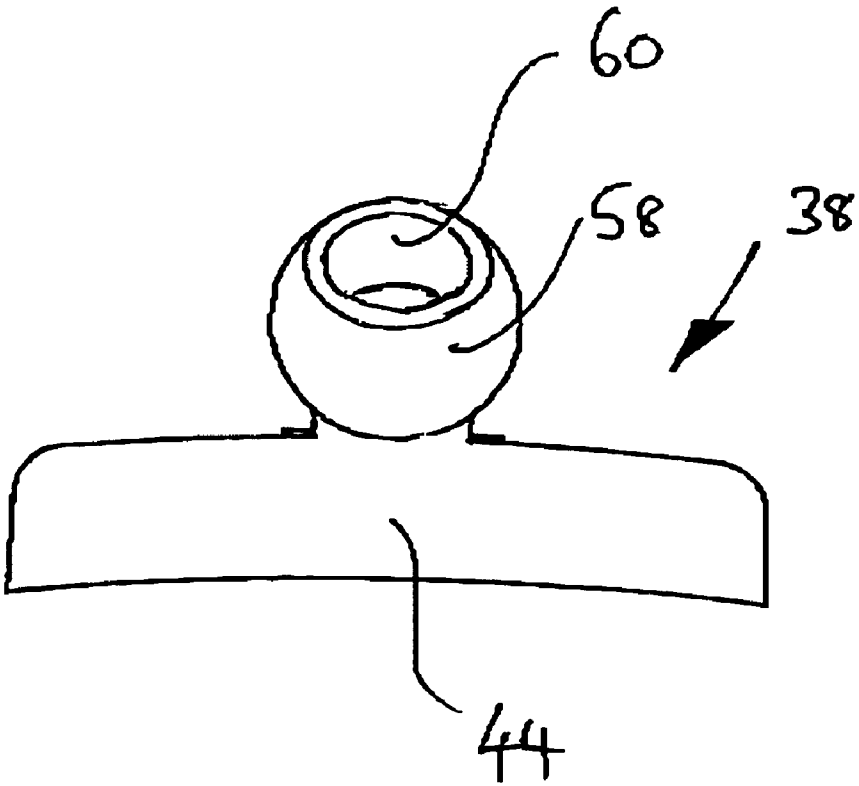
FIG. 10 is a view in the direction X of FIG. 8.
Figure 11:
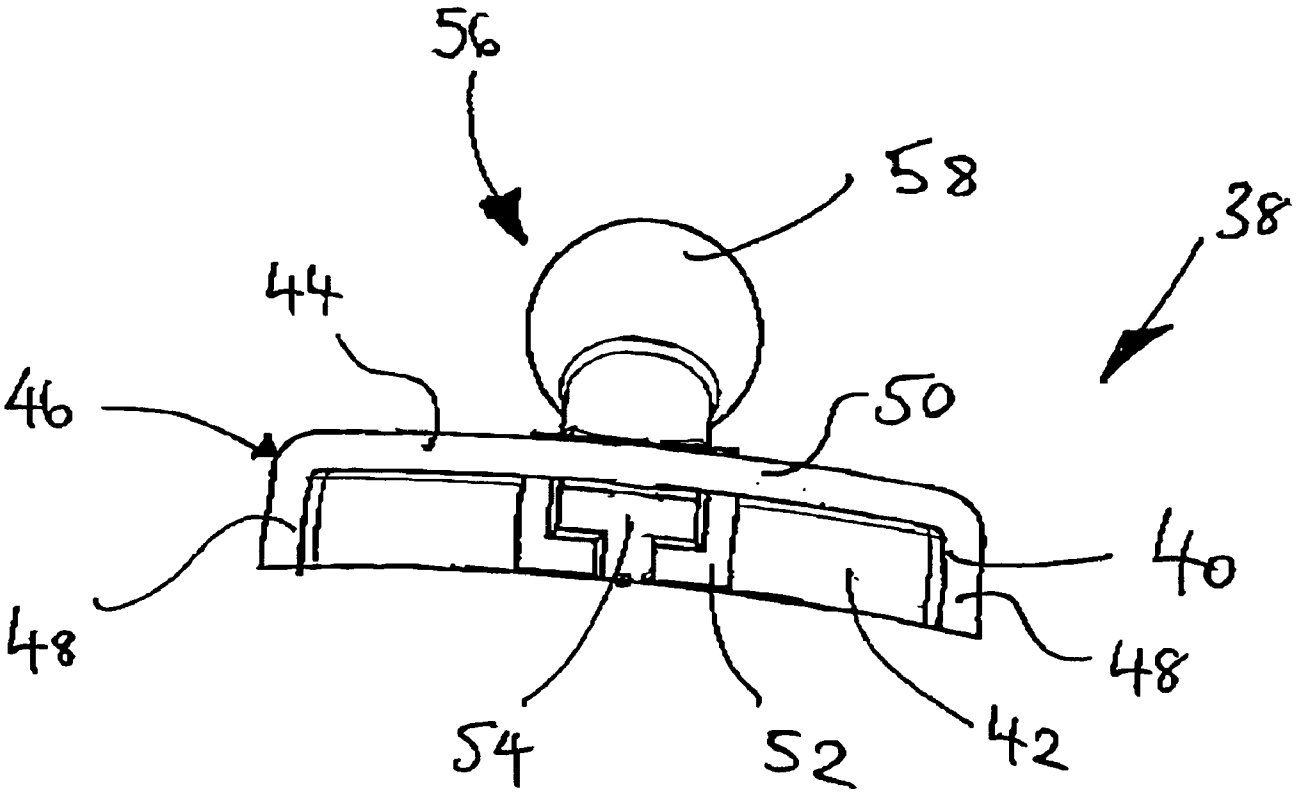
FIG. 11 is a view in the direction XI of FIG. 8.

In more detail, the means 14 to attach the deflector comprises a first part 16 (FIGS. 4 to 7) in the general form of a base plate 18. The base plate 18 is generally curved to locate around the usual curvature of a toilet T to which the arrangement 10 is to be attached (see FIG. 7). A series of apertures 20 is provided in the base plate 18 through which securing means (not shown), such as screws or bolts can be used to securely fix the first part 16 to a toilet. Alternatively, the apertures may not be completely formed in the plate, but outlined, for example by way of perforations, to be formed if necessary or desired.

The face 22 of the plate 18 which in use locates against a toilet T is generally smooth. The face 24 of the other side 26 of the plate 18 comprises an elongate locating formation 28 of generally "T" shaped cross-section and which extends in use generally downward. Two generally parallel locating recesses 30 are provided to be generally symmetrically disposed in spaced configuration on either side of the locating formation 28. A further locating recess 32 is also formed in the base plate 18 to extend generally perpendicularly between the recesses 30, and just below in use the formation 28. A lobe 34 extends generally downward from one side of the recess, which lobe 34 may bear trade mark or other matter.

An adhesive pad 36 (FIG. 1) is provided to attach the first part 16 to a toilet T, as will be described.

The attachment means 14 further comprises a first section in the form of a mounting joint 38 (FIGS. 8 to 11).

The mounting joint 38 comprises a mounting body 40 which defines a recess 42 between a front section 44 and an upstanding wall section 46 comprised of two generally parallel sections 48 connected at one end thereof by a further section 50. The configuration of the upstanding wall 46 is such that when the mounting joint 38 is located in position on the base plate 18, as will be described, the parallel wall sections 48 locate in the recesses 30, as will be explained.

Extending from the section 50 generally centrally between and parallel to the sections 48 is a further section 52 which defines a generally T-shaped channel 54. The chapel 54 is operable to slidingly receive the locating formation 28 in use, as will be explained.

A joint projection 56 extends generally centrally from between the front section 44 and the section 50, at an angle of approximately 45°. The projection comprises a ball or part ball formation 58 on the free end thereof in which is provided a recess 60 which enables the ball section 58 to be compressed to locate in a corresponding socket to form a joint as will be explained.

Figure 12:
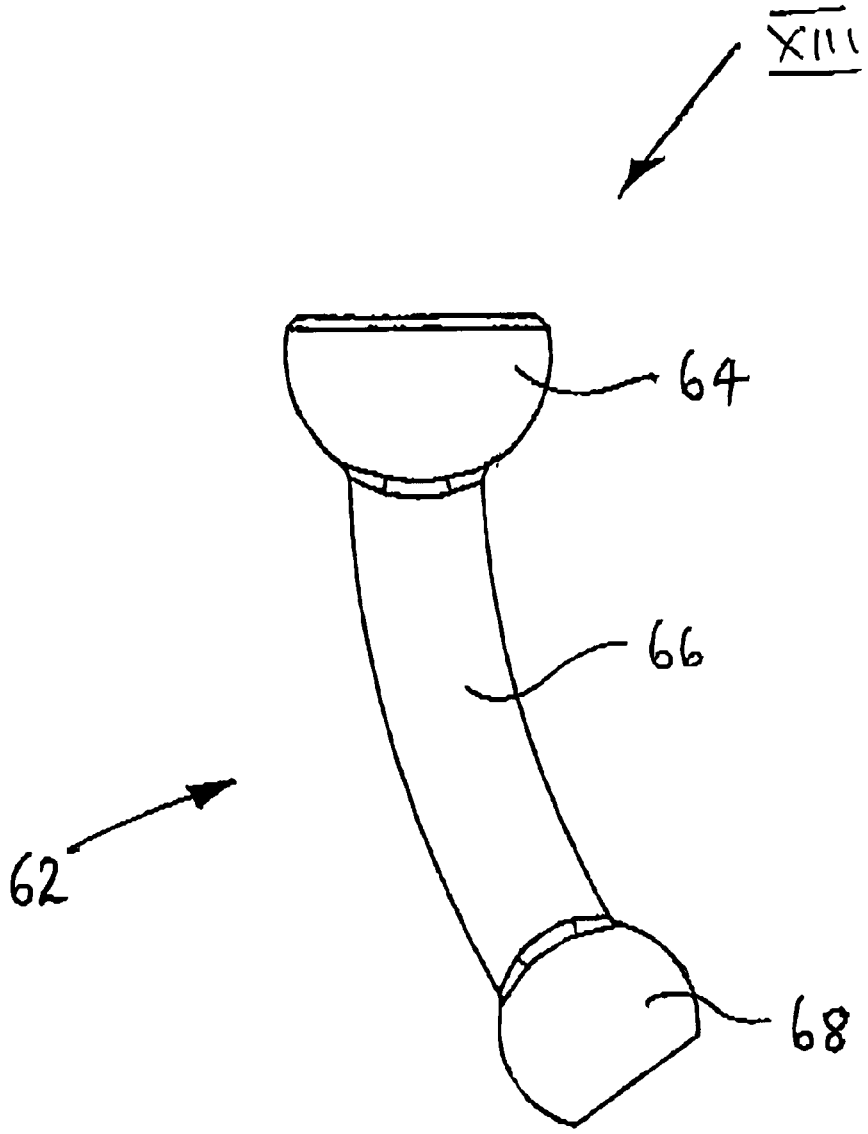
FIG. 12 is a side view of a second section of the second part of the arrangement of FIG. 1.
Figure 13:
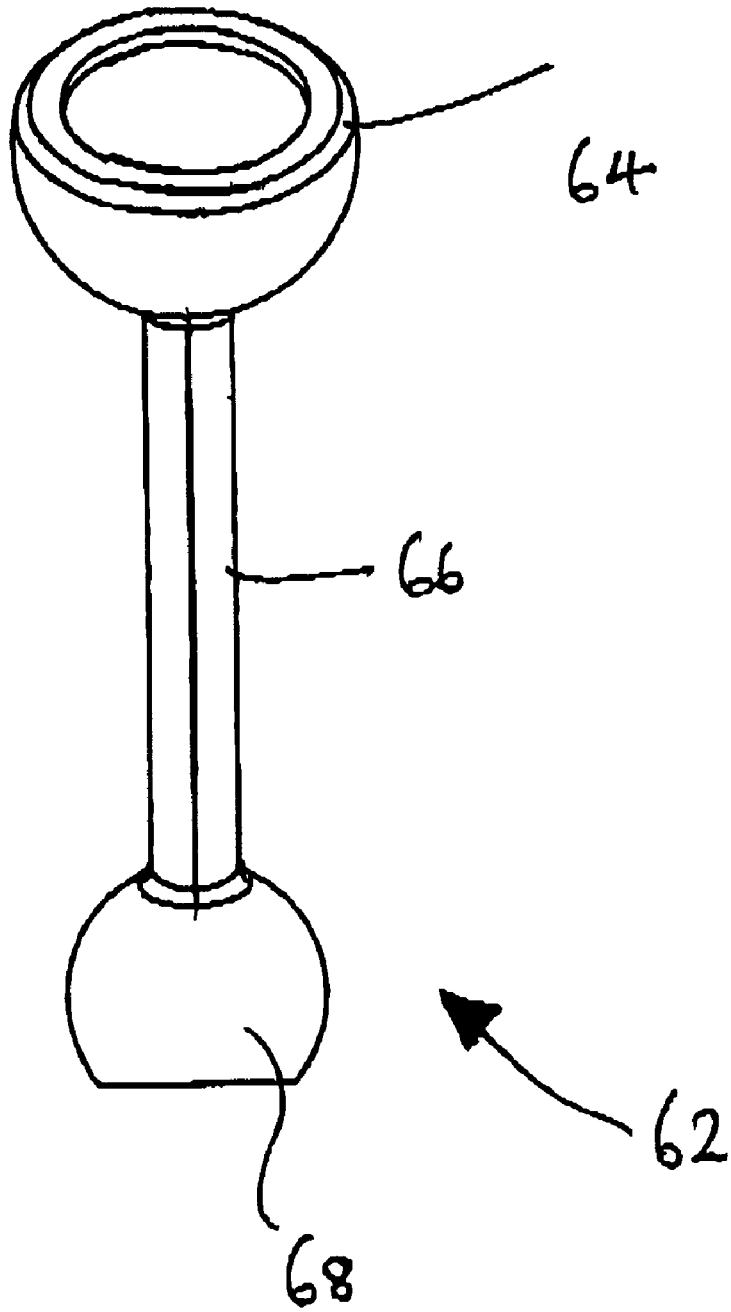
FIG. 13 is a view in the direction of arrow XIII of FIG. 12.
Figure 14:
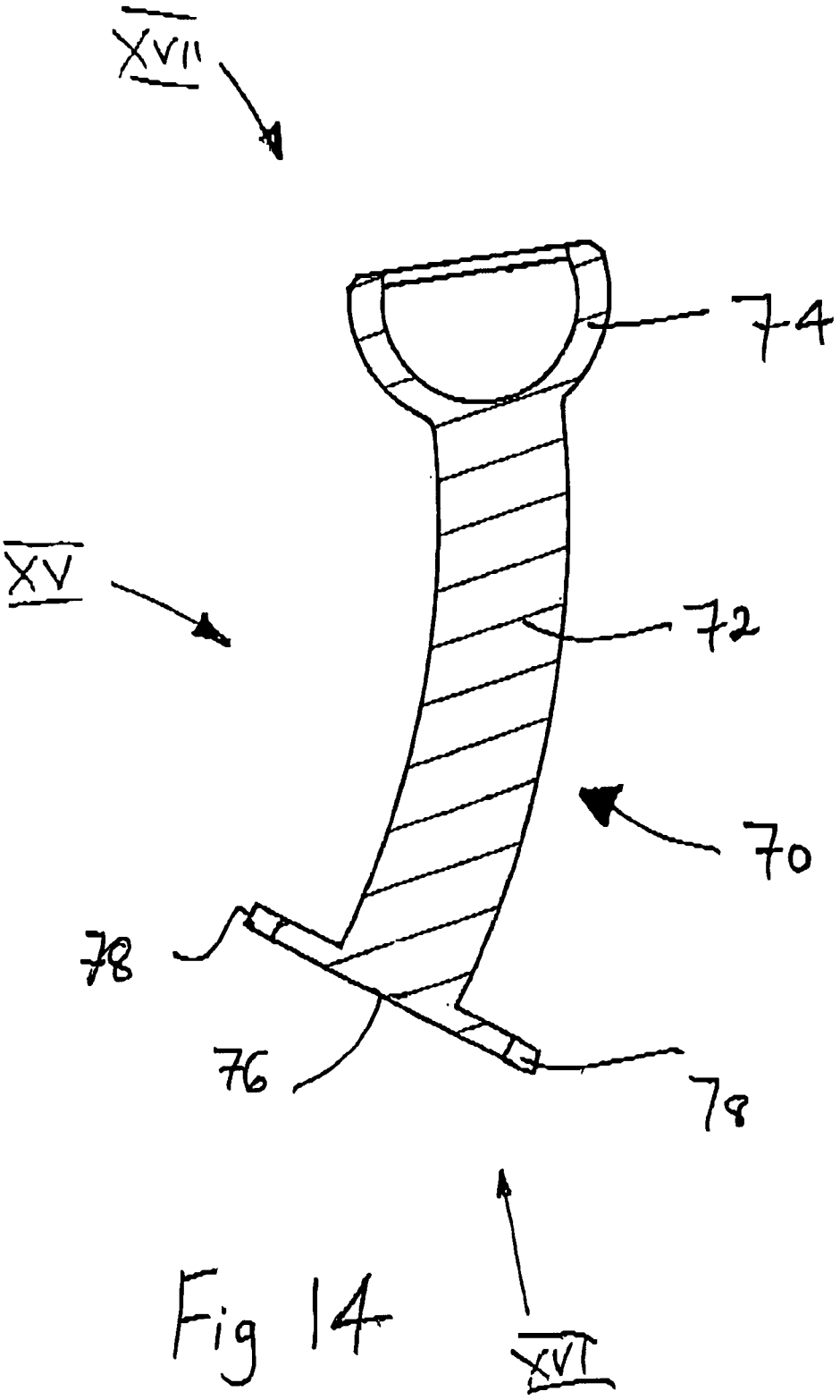
FIG. 14 is a cross-sectional side view of a third section of a second part of the arrangement of FIG. 1.
Figure 15:
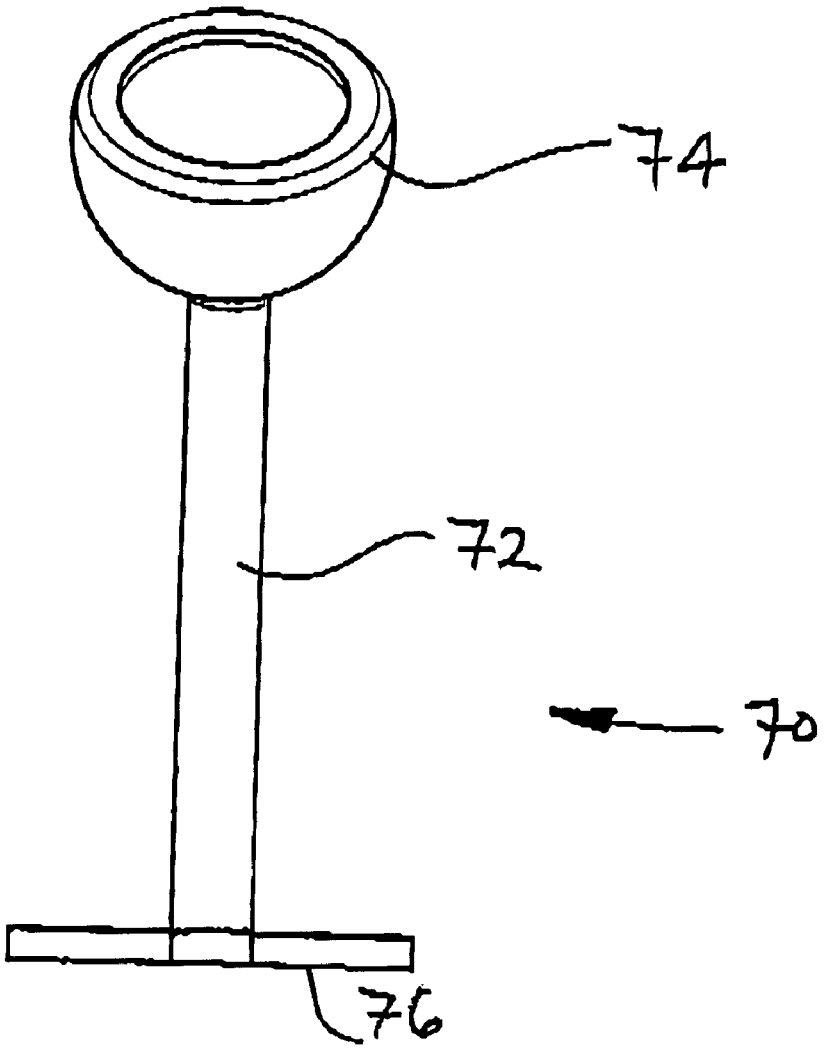
FIG. 15 is a view in the direction of arrow XV of FIG. 14.
Figure 16:
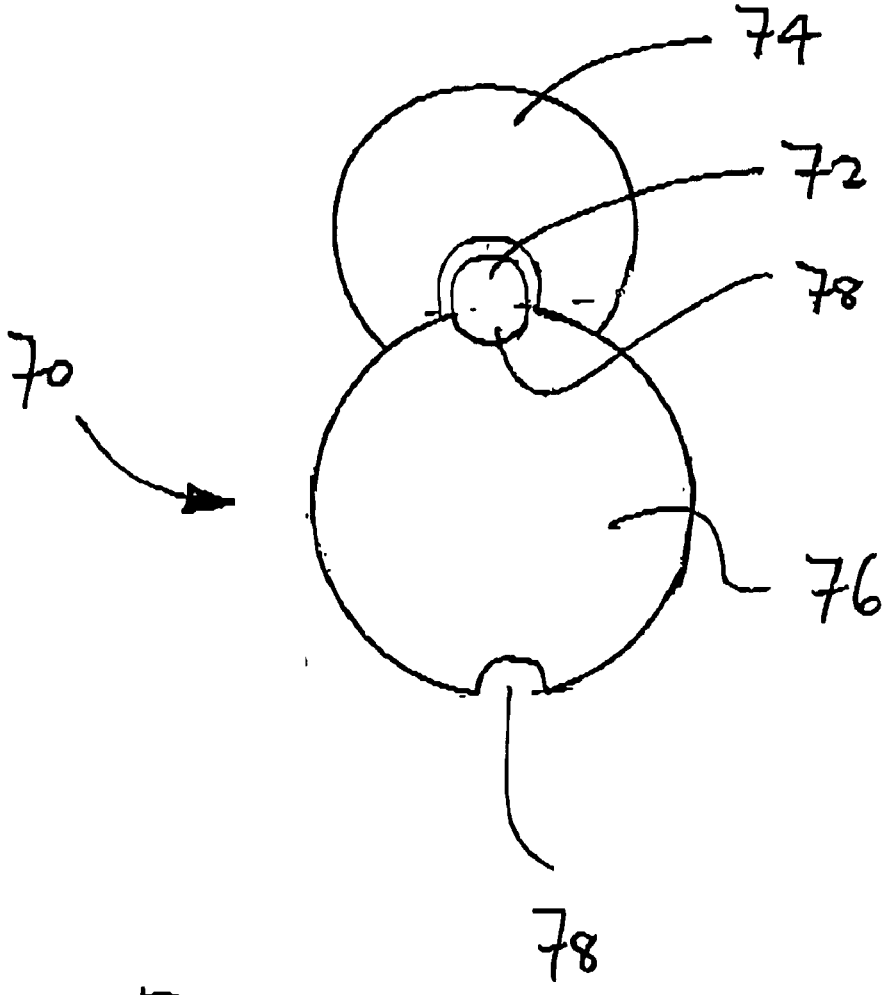
FIG. 16 is a view in the direction of line XVI of FIG. 14.
Figure 17:
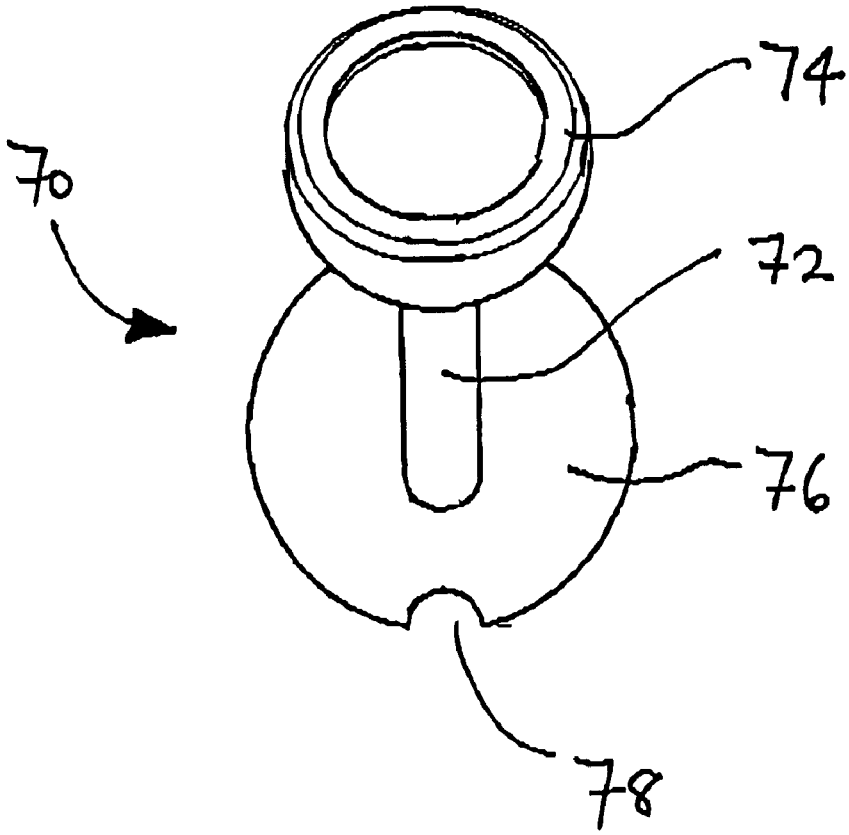
FIG. 17 is a view in the direction of XVII of FIG. 14.

The attachment means 14 further comprises a second section 62 as shown in FIGS. 12 and 13. The second section 62 comprises a socket formation 64 located on one end of a curved body 66 and a part ball shaped joint formation 68 on the other end of said curved body 66.

The attachment means 14 comprises a third section 70 as shown in FIGS. 14 to 17. The section 70 comprises a curved body 72 on one end of which is a socket formation 74 similar to the socket formation 64 described above. The socket formation 74 is operable to receive ball or part ball formations otherwise comprised in the attachment means 14 as will be described.

A locating plate 76 is located on the other end of the curved body 72. The locating plate is generally in the form of a disc having two curved cut-outs 78 formed in the edge thereof to be generally opposing.

Figure 18:
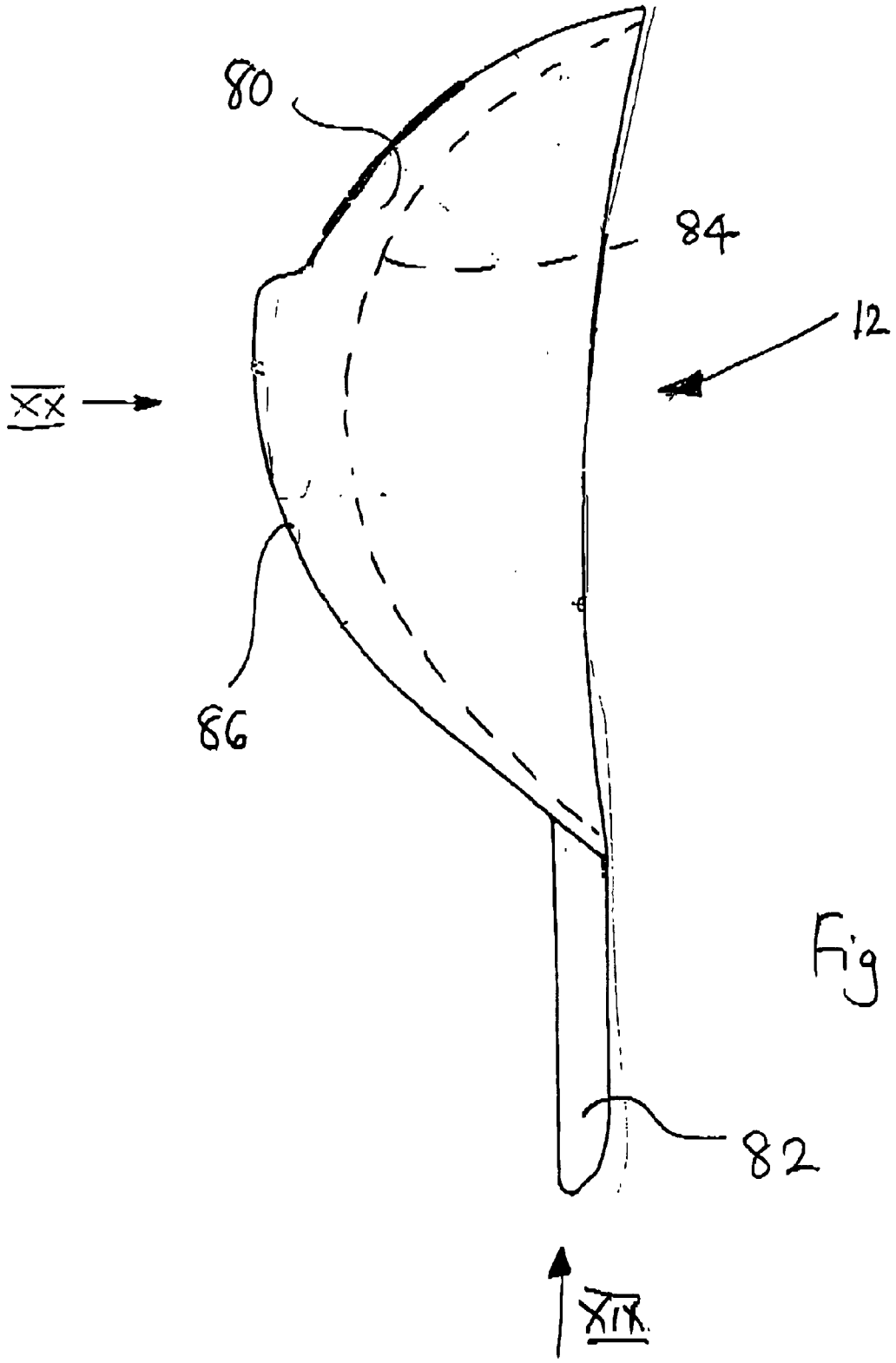
FIG. 18 is a side view of a deflector of the arrangement of FIG. 1.
Figure 19:
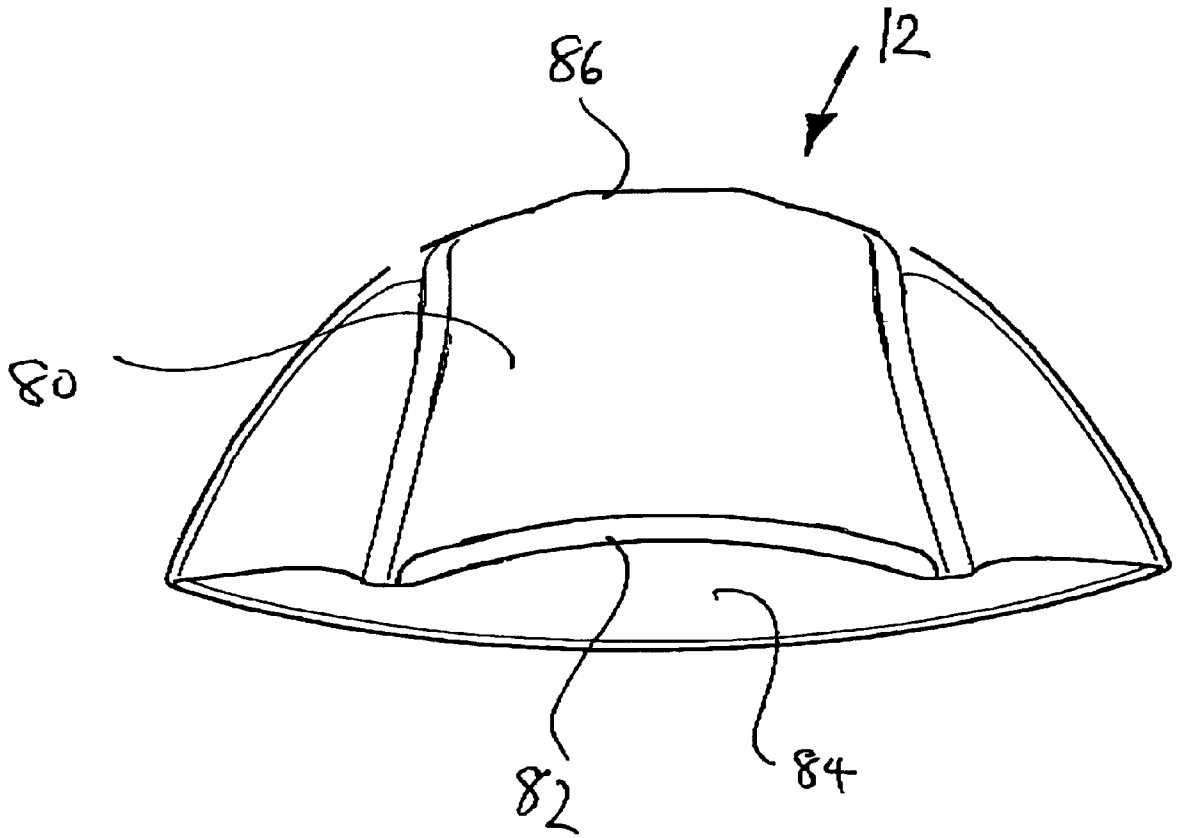
FIG. 19 is a view in the direction XIX of FIG. 18.
Figure 20:
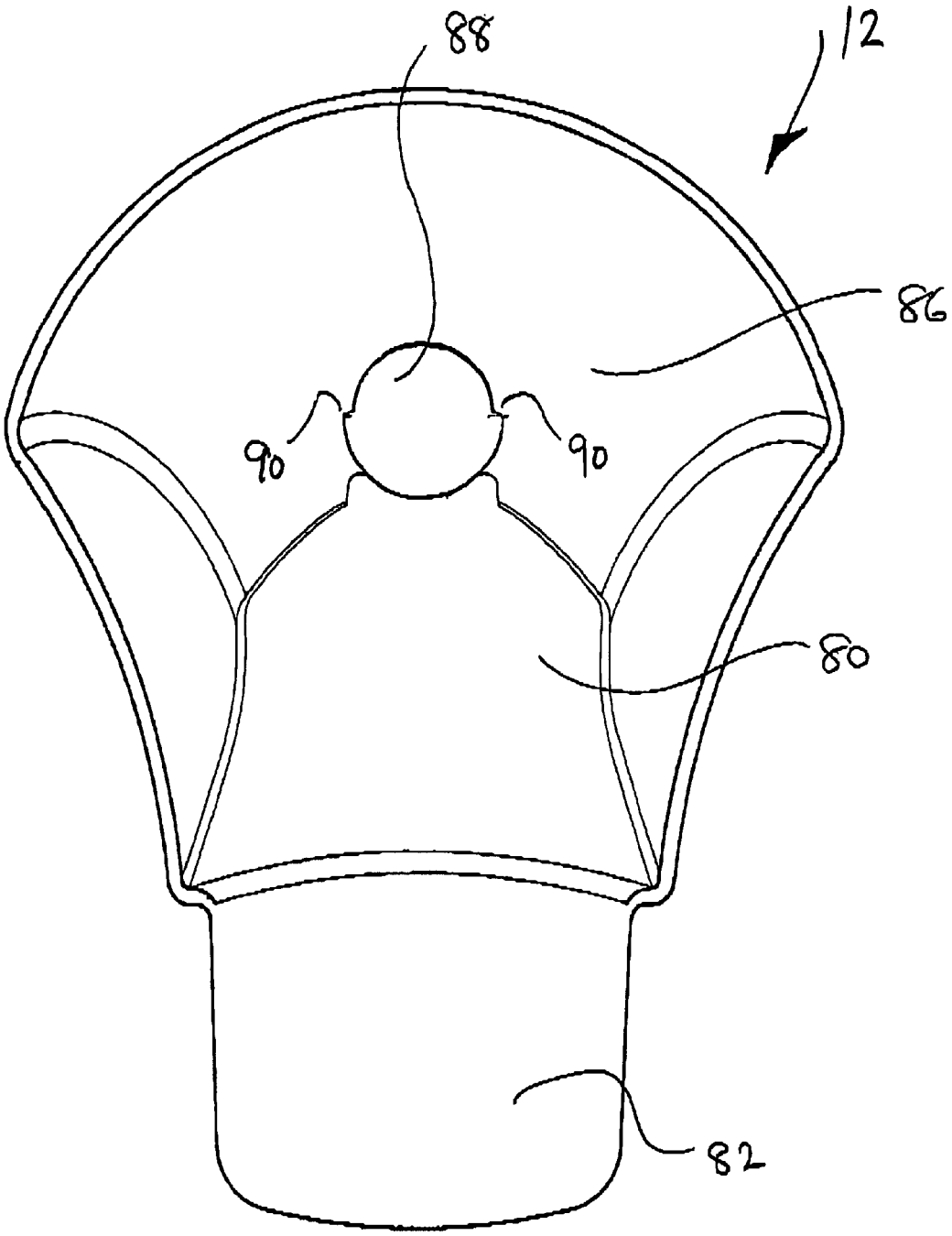
FIG. 20 is a view in the direction of arrow XX of FIG. 18.

The deflector 12 (FIGS. 18 to 20) comprise an upper, concave portion 80 and a generally planar portion 82 extending from the in-use lower edge thereof. The inner concave surface 84 of the portion 80 is operable to deflect fluid impinging thereon, as will be explained. The portion 82 acts to guide fluid running from the concave surface 84, again as will be described.

Figure 21:
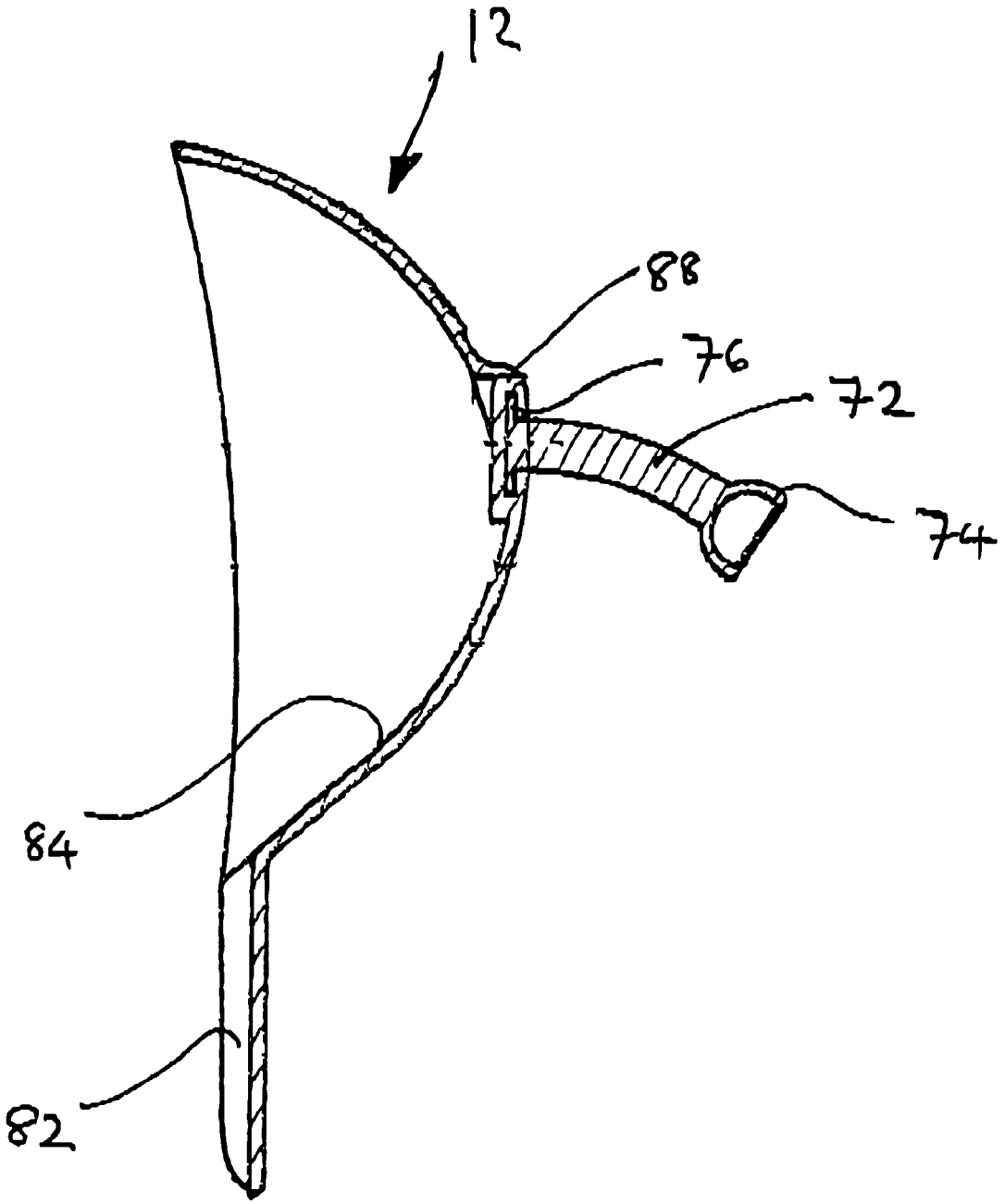
FIG. 21 is a cross-sectional view of the deflector of FIG. 18 with the third section of the second part attached thereto for use for use.
Figure 22:
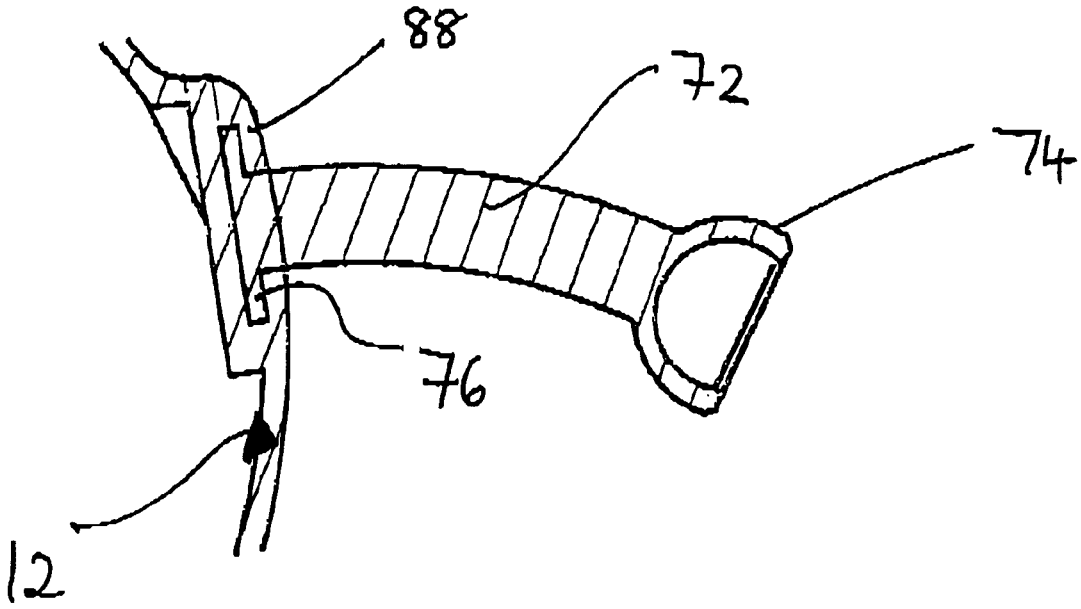
FIG. 22 is an enlarged cross-sectional view of the attachment of the said section and deflector of FIG. 21.

On the in-use front 86 of the deflector 12 is a sleeve or socket 88 (FIG. 20) in which the locating plate 76 of a the section 70 is locatable to attach the deflector 12 to the attachment means 14. The sleeve 18 is configured to slidingly receive the locating plate 76 for a snap-fit location of small lugs 90 in the cut-outs 78. Attachment of the section 70 to the deflector 12 is illustrated in FIGS. 21 to 22.

Figure 2:
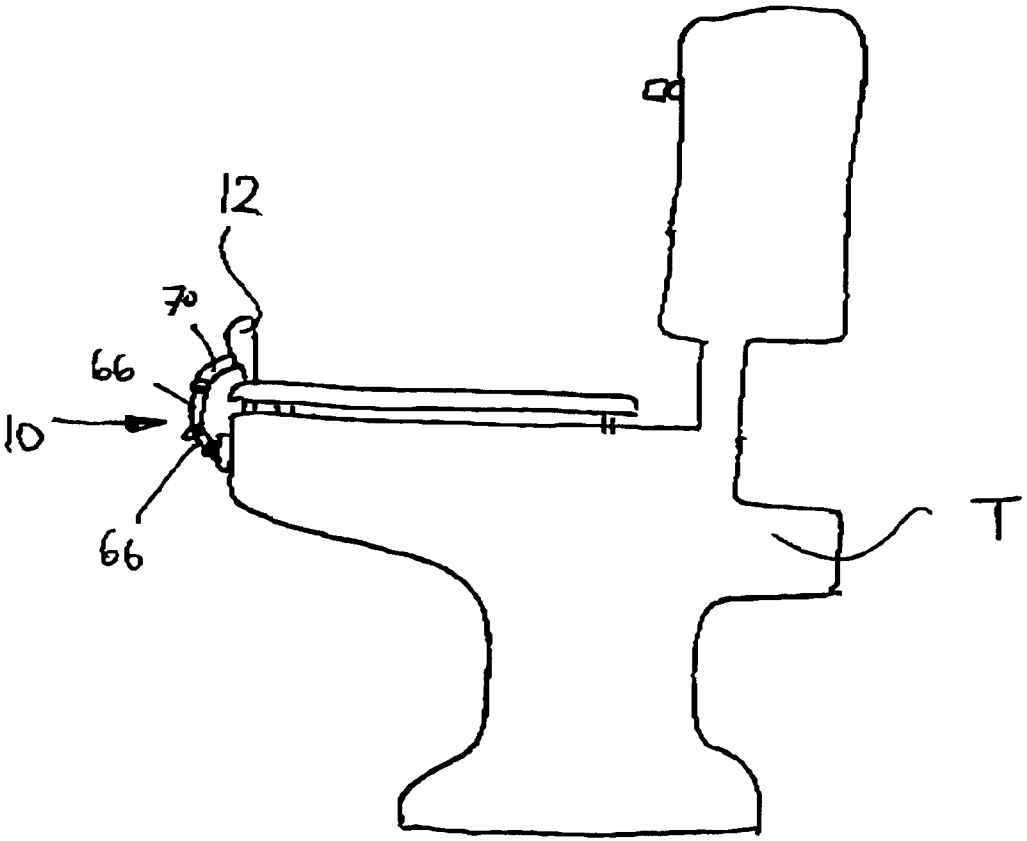
FIG. 2 is a diagrammatic illustration of the arrangement of FIG. 1 in use on a toilet.
Figure 3:
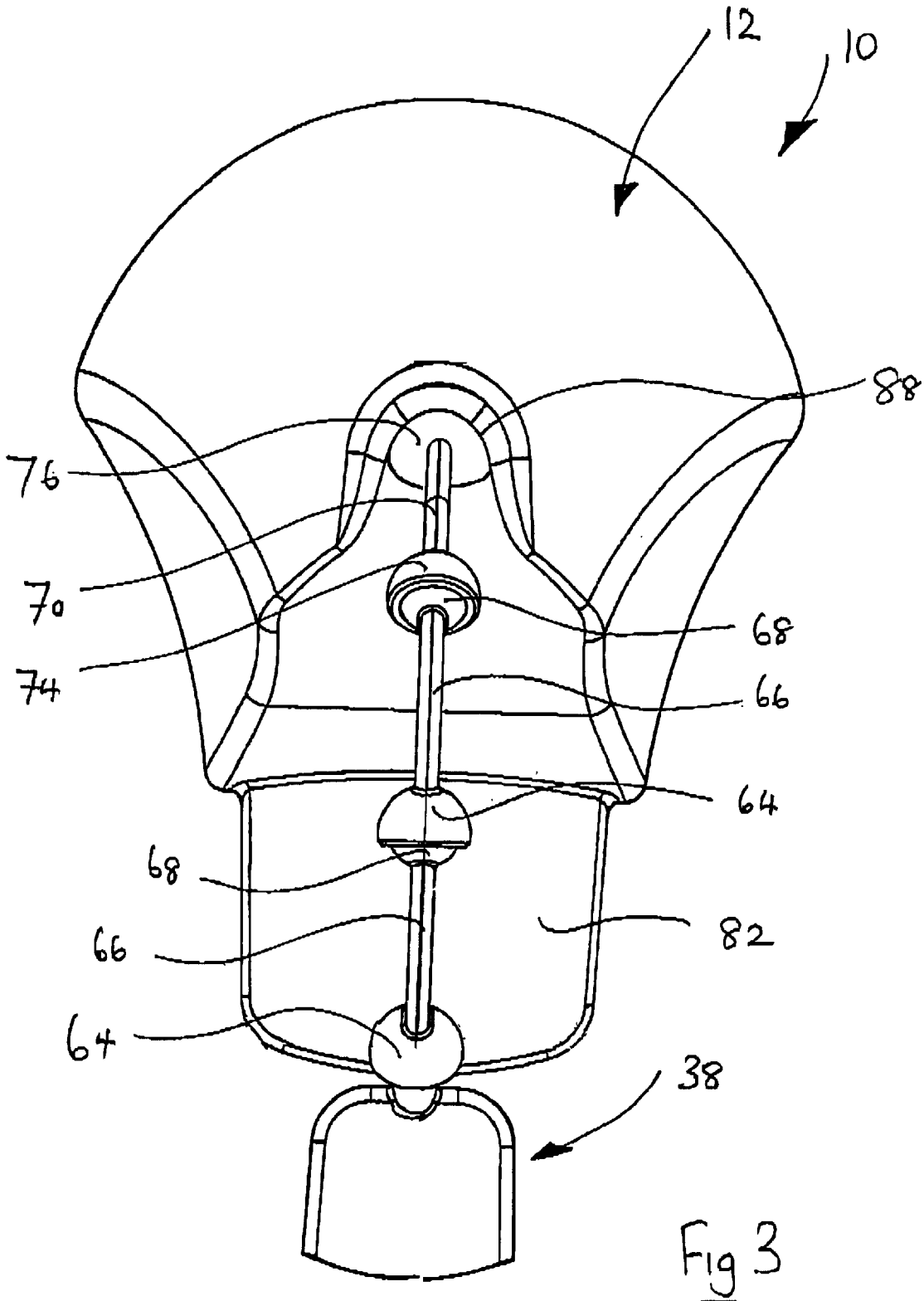
FIG. 3 is a view in the direction of arrow III in FIG. 1.
Figure 4:
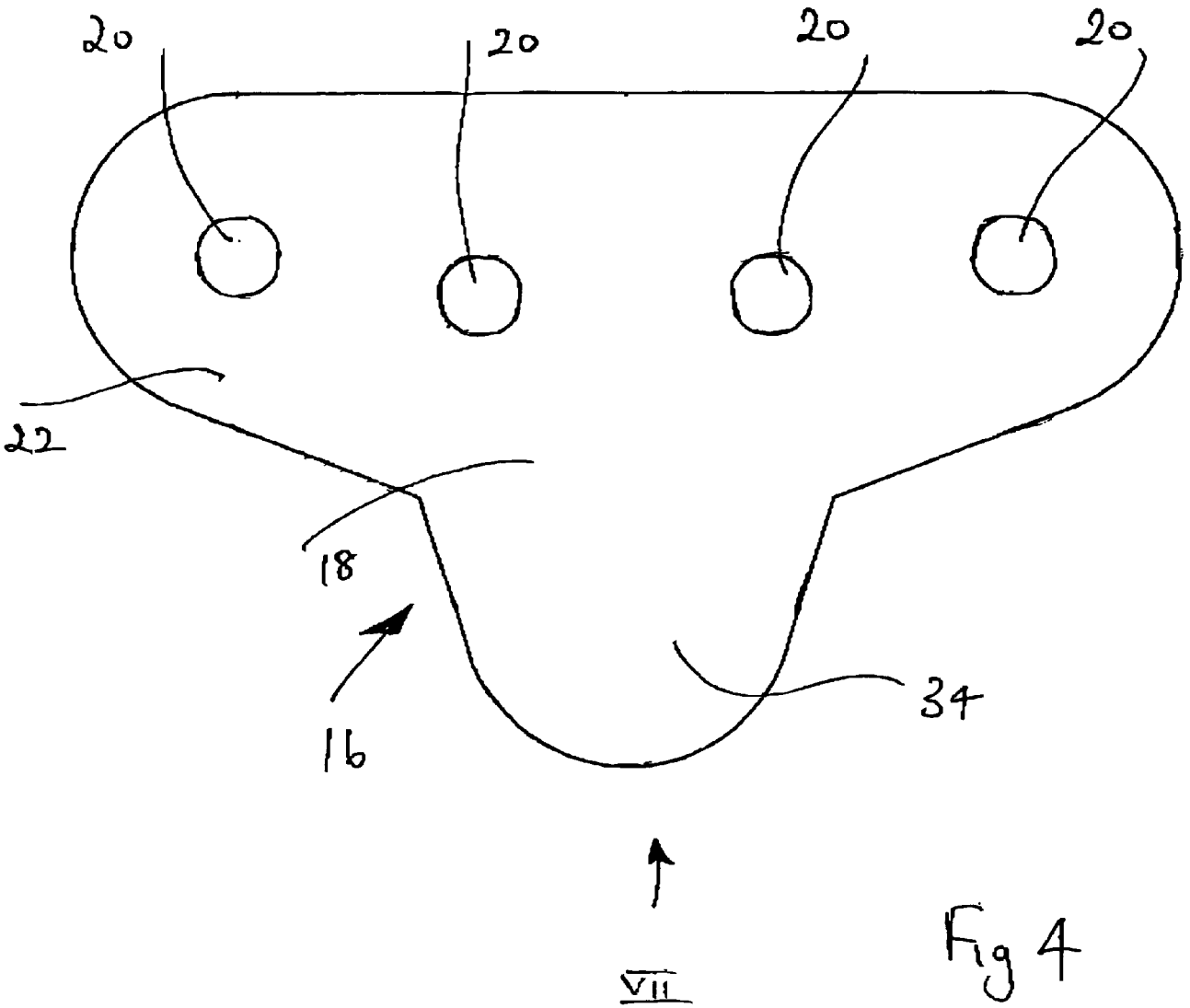
FIG. 4 is a view of one side of a first part of the arrangement of FIG. 1.
Figure 5:
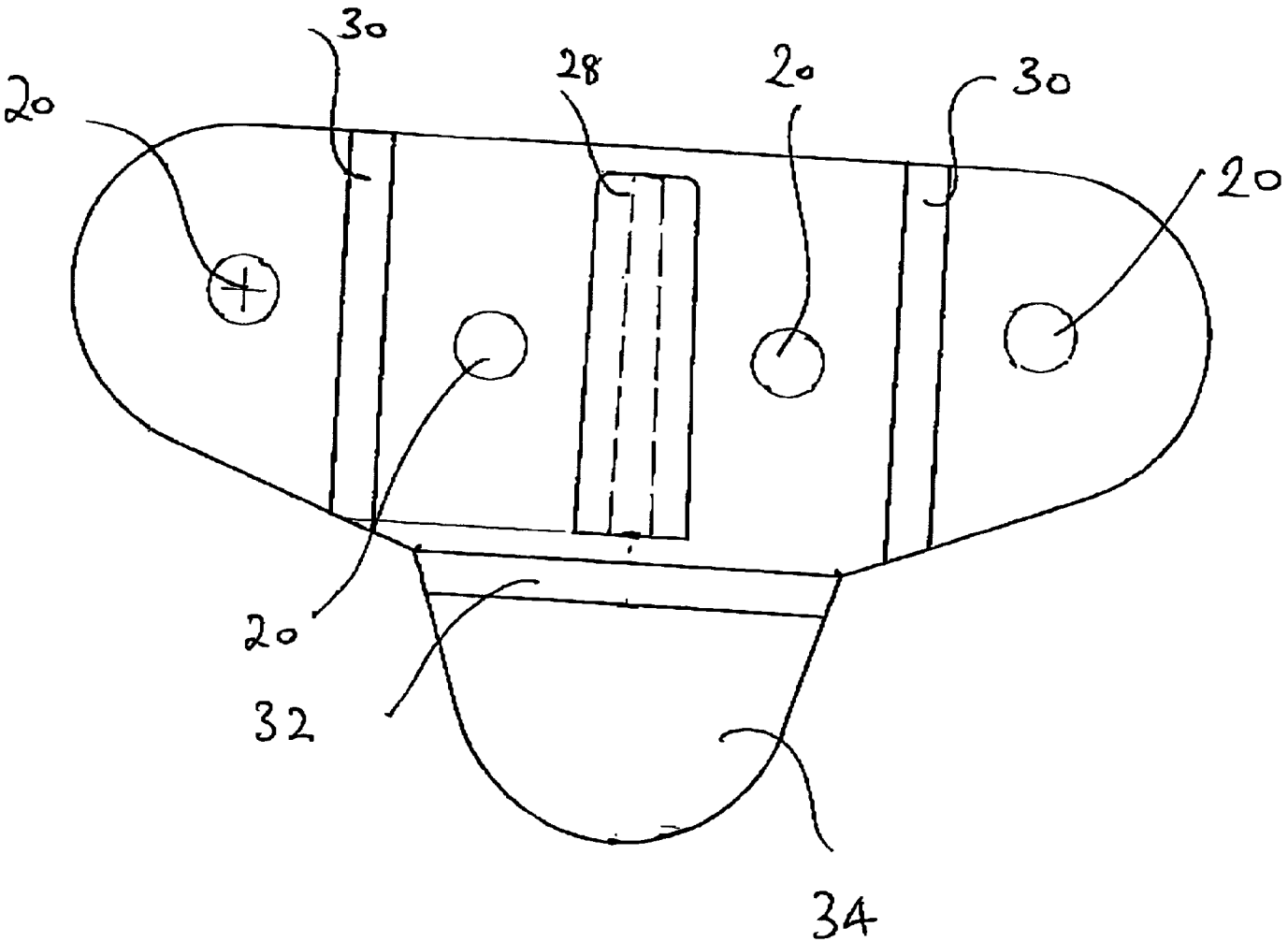
FIG. 5 is a view of the other side of the part of FIG. 4.
Figure 6:
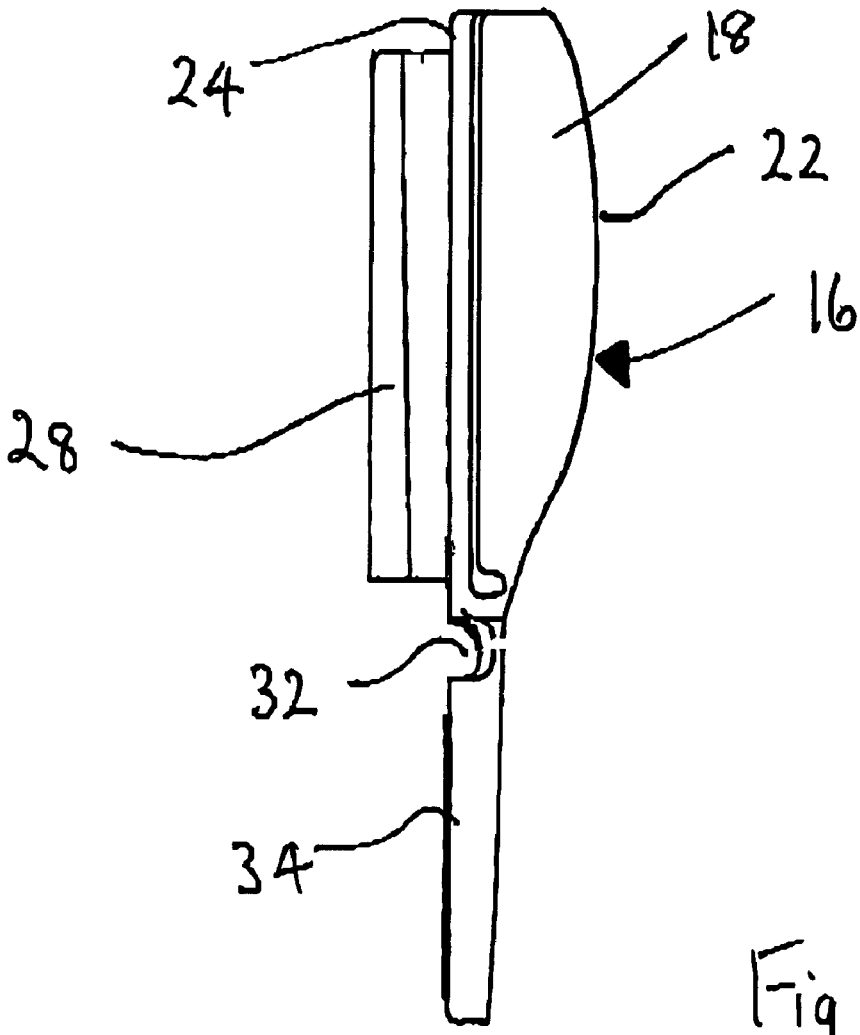
FIG. 6 is an end view of the part of FIG. 4.

In use, the arrangement 10 is mountable to the front of a toilet T and in this embodiment is intended for mounting on a front surface of the bowl of a toilet T as shown in FIG. 2.

It is to be appreciated however that it is within the scope of the present invention for the arrangement to be mountable to a seat of the toilet.

To mount the arrangement 10, the base plate 18 is first secured to the front surface of the bowl of the toilet $T_1$ to be generally central such that when the deflector 12 is in the operative position it is located generally between the legs of a person sitting on the toilet T. It will be appreciated however that the base plate 18 could be mounted in other positions on the toilet.

To mount the base plate 18, an adhesive pad 36 is used, and if necessary further retaining means, such as bolts (not shown) can be used to locate through the apertures 20 and corresponding apertures formed in the toilet T.

It has been found useful to assemble the rest of the arrangement 10 before attachment thereof to the base plate 18, and to this end, the locating plate 76 of the third section 70 is slid into the sleeve 88 on the deflector 12 to securely locate therein with the lugs 90 located in the cut-outs 78.

A second section 62 is then attached to the further section 70 by locating the ball formation 68 into the socket 74. The resilience of the ball formation 68 and also the socket 74 enables the ball formation 68 to be pushed into the socket 70 effectively to form a snap-fit. The ball formation 68 and socket 74 thereby form a pivotal ball joint. A further second section 62 is then attached to the other end of the first section 62 in similar manner.

The mounting joint 38 is then connected to the socket 64 of the further section again by way of a snap-fit location of the ball formation 58 in the socket 64.

This part assembly of the arrangement 14 is then mounted on the base plate 18 by offering the mounting joint 38 up to the base plate 18, such that the locating formation 28 is at the entrance to the "T" shaped channel 54 and the parallel sections 48 of the wall 46 are located at the upper ends of the recesses 30. The mounting joint 38 is then slid down over the locating formation 28 until the locating formation is located within the channel 54, whereby the arrangement 10 is securely attached to a toilet T.

The ball and socket joints provided between the respective sections provide for versatile movement of the deflector 12 on the toilet, enabling the deflector 12 to be moved to and from the operative position.

In the operative position, a deflector 12 locates generally between the legs of a person sitting on the toilet T. Ideally the concave portion 18 is located to generally rest on the front of the toilet or toilet seat with the portion 82 extending downward into the toilet.

If a male user of the toilet when in the seated position accidentally directs urine out of the front of the toilet, this would be deflected back into the toilet by the deflector 12 with the planar portion 82 further facilitating redirection of the urine into the toilet, thereby preventing or reducing the spoiling of the area outside the toilet.

When the arrangement 10 is no longer required for use, the deflector 12 can be simply and easily moved away from the operative position to a stowage position at the front of the toilet.

Various modifications may be made without departing from the spirit or scope of the present invention. For example, the arrangement 10 may be attached to a toilet using any suitable means, and may be reversibly or irreversibly attached. Any number of pivotal joints may be provided in the arrangement. The arrangement may be integrally formed within a toilet, and particularly in a toilet seat, such as a raised toilet seat.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A deflector arrangement comprising a deflector and means to attach the deflector to a toilet and enable the deflector to be selectively moved between an operable position in which the deflector can deflect urine into the toilet and a plurality of further positions outside of the toilet in which the deflector presents no or substantially no obstacle to a user of the toilet, particularly when the user is getting on and off the toilet.

2. A deflector arrangement according to claim 1, in which the deflector is located generally at the front of the toilet when in the operable position.

3. A deflector arrangement according to claim 2, in which the deflector is located generally centrally whereby to locate between the legs of a person sitting on the toilet.

4. A deflector arrangement according to claim 1, in which the deflector is located generally beneath the seating area of a toilet.

5. A deflector arrangement according to claim 1, in which the deflector comprises a concave surface which when in the operable position generally faces a person sitting on the toilet, whereby to direct urine impinging thereon into the toilet.

6. A deflector arrangement according to claim 5, in which the deflector extends, in part, into the toilet whereby to facilitate direction or urine therein.

7. A deflector arrangement according to claim 1, in which the said means comprises a first part attachable to a toilet and a second part operable to enable movement of the deflector on the first part.

8. A deflector arrangement according to claim 7, in which the movement is pivotal.

9. A deflector arrangement according to claim 7, in which the second part is articulated.

10. A deflector arrangement according to claim 9, in which the second part comprises a series of pivotal joints along a length connecting the first part to the deflector.

11. A deflector arrangement according to claim 10, in which some or all of the joints are in the form of ball and socket joints or similar to provide multiaxial pivotal movement.

12. A deflector arrangement according to claim 7, in which the first part is removably attachable to a toilet.

13. A deflector arrangement according to claim 7, in which the first part is attached to adhesive and/or fixings such as threaded fixings.

14. A deflector arrangement according to claim 7, in which the first part is substantially permanently attached to the toilet.

15. A deflector arrangement according to claim 7, in which the arrangement is attachable to the main body or bowl of the toilet.

16. A deflector arrangement according to claim 7, in which the arrangement is attachable to a seat member of a toilet.

17. A toilet seat comprising a deflector arrangement as described in claim 1.

18. A toilet comprising a deflector arrangement as described in claim 1.

* * * * *